US007325701B1

(12) United States Patent
Meyer et al.

(10) Patent No.: US 7,325,701 B1
(45) Date of Patent: Feb. 5, 2008

(54) DISPENSER FOR CUP-SHAPED ARTICLES WITH IMPROVED CLAMP-RING SECUREMENT FEATURE

(75) Inventors: Michael H. Meyer, Sagamore Hills, OH (US); Henry G. Roethel, Ravenna, OH (US); Raymond P. Kawolics, Solon, OH (US); Daniel A. Sokolowski, Bedford Heights, OH (US)

(73) Assignee: The Meyer Company, Cleveland, OH (US)

( * ) Notice: Subject to any disclaimer, the term of this patent is extended or adjusted under 35 U.S.C. 154(b) by 354 days.

(21) Appl. No.: 10/804,777

(22) Filed: Mar. 19, 2004

Related U.S. Application Data

(60) Provisional application No. 60/455,821, filed on Mar. 19, 2003.

(51) Int. Cl.
*A47F 1/06* (2006.01)

(52) U.S. Cl. ..... 221/310; 221/304; 221/221

(58) Field of Classification Search ..... 221/310, 221/304, 221
See application file for complete search history.

(56) References Cited

U.S. PATENT DOCUMENTS

| | | | | |
|---|---|---|---|---|
| 3,581,934 | A * | 6/1971 | Sciascia | 221/304 |
| 4,234,101 | A * | 11/1980 | Pastore | 221/241 |
| 5,199,601 | A | 4/1993 | Roethel | |
| 5,201,869 | A | 4/1993 | Roethel | |
| 5,222,628 | A * | 6/1993 | Roethel | 221/307 |
| 6,199,723 | B1 * | 3/2001 | Collins et al. | 221/307 |
| 2001/0032860 | A1 * | 10/2001 | Roethel et al. | 221/282 |

* cited by examiner

*Primary Examiner*—Gene O. Crawford
*Assistant Examiner*—Timothy Waggoner
(74) *Attorney, Agent, or Firm*—Fay Sharpe LLP

(57) ABSTRACT

A dispenser for cup-shaped articles comprises a body defining a storage region for receiving an associated stack of cups or other cup-shaped articles. The body comprises an open end that communicates with the storage region. A resilient diaphragm restricts the open end of the body. A clamp member is releasably secured adjacent the open end of the body and retains the diaphragm relative to the open end of the body. A mounting flange projects outwardly away from the body. The clamp member and mounting flange comprise mating structures that releasably secure said clamp member to the mounting flange.

9 Claims, 8 Drawing Sheets

DISPENSER FOR CUP-SHAPED ARTICLES WITH IMPROVED CLAMP-RING SECUREMENT FEATURE

CROSS-REFERENCE TO RELATED APPLICATION

This application claims priority from and benefit of the filing date of U.S. provisional patent application Ser. No. 60/455,821 filed Mar. 19, 2003.

BACKGROUND

The present invention is directed toward the art of dispensers for cups and other cup-shaped articles (e.g., french fry containers, soufflé cups, ice-cream cones, etc.) and, more particularly, to a new and unobvious diaphragm-type dispenser assembly and method of manufacturing same. The term "cup" as used herein is intended to encompass these and any other cup-shaped article suitable for being dispensed one-at-a-time from an interfitted stack. Dispensers of the type under consideration herein are commonly employed in restaurants and convenience stores to maintain a supply of paper, plastic, foam, and/or other disposable cups and/or cup-shaped articles near beverage or soft-serve frozen food dispensing equipment for use as required.

FIGS. 1 and 2 illustrate one example of a known diaphragm-type dispenser assembly A for dispensing cup-shaped articles. As illustrated in FIG. 1, the dispenser A is mounted in a cabinet or other mounting structure B and is adapted to maintain a supply of cups C in a readily available condition. The mounting structure B defines an opening D into which the cup dispenser is A is inserted and, as is described in full detail below, the dispenser A is fixedly secured to the mounting structure B in an operative position.

More particularly, the dispenser assembly A comprises an elongated cup storage tube or body 10 including an inner surface 12 that defines a hollow cup storage region 14 adapted to receive a telescopically interfitted stack S of cup-shaped articles C to be dispensed one-at-a-time. The body 10 is illustrated in the preferred, substantially cylindrical conformation, but those of ordinary skill in the art will recognize that the body 10 can be defined in any of a wide variety of other configurations so that it defines an elongated cup storage region 14 adapted to receive and confine a telescopically interfitted stack S of cups C.

The body 10 is elongated along a longitudinal axis L (FIG. 2) and comprises an open first end 20 and a closed second end 22. The second end 22 is typically closed by an integral transverse end wall 24. The body 10 can be defined from metal or plastic or any other suitable material as desired.

In the illustrated embodiment, the body 10 includes a plurality of lugs or bosses 40*a*-40*d* defined therein near the open first end 20 (closer to the open end 20 than the closed end 22). If the body is plastic, the bosses 40*a*-40*d* are defined during the molding operation and project outwardly from the outer surface of the body. As illustrated in FIG. 1, the bosses 40*a*-40*d* each define a sloping face 42 that diverges away from the body when considered in a direction from the first end 20 toward the second end 22 of the body. The illustrated body includes four bosses 40*a*-40*d* defined symmetrically about the body, but those of ordinary skill in the art will recognize that any number of bosses can be defined, and that these can be arranged in any desired relationship relative to each other.

The cup dispenser assembly A further comprises an annular mounting collar 50 defined by a cylindrical or base portion 52 and a flange 54 that projects radially outward from the cylindrical portion 52. The cylindrical portion 52 includes or defines a plurality of recesses or other apertures 56*a*-56*d* that open inwardly toward the center of the collar 50. These recesses 56*a*-56*d* are dimensioned and arranged and otherwise adapted for respective receipt of and engagement with the bosses 40*a*-40*d* when the collar 50 is coaxially fitted to upper end 20 of the body 10 as illustrated in FIG. 1.

The collar flange 54 defines a plurality of mounting apertures, preferably in the form of keyhole slots 60. When the cup dispenser A is to be installed into a mounting structure B, the closed second end 22 of the body 10 is placed into an opening D defined in the mounting structure, and body 10 is inserted into the mounting structure through the opening D until the collar flange 54 abuts a surface of the mounting structure as illustrated in FIG. 1. The flange 54 is then fixedly secured to the mounting structure B, preferably by use of the fasteners 62 (see FIG. 2) that pass through the keyhole slots 60.

In the illustrated embodiment, an outermost edge 70 of the body 10 projects outwardly above the flange 54 of collar 50. This outermost body edge 70 provides a convenient mounting location for a flexible resilient diaphragm member 80 that defines a central opening 82. As illustrated in FIG. 1, the diaphragm member 80 is preferably dished and sized appropriately so that it frictionally engages the outermost edge 70 of the cup storage body 10 so as to be positioned adjacent and restrict the open end 20 of the body 10 to prevent uncontrolled release of cup-shaped articles C from stack S. The edge 70 preferably includes or defines a radially enlarged lip 72 (see also FIG. 2) that engages the diaphragm member 80 to strengthen the frictional engagement between the member 80 and the body 10. In this operative position, the diaphragm 80 is said to be adjacent the open end 20 of the body 10 and restricts the open end to prevent uncontrolled release of the stack S of cup-shaped articles.

With particular reference now to FIG. 2, the diaphragms 80',80" are similar in all respects to the diaphragm 80, but include central openings 82',82" that are defined to have a different size compared to the opening 82 of the diaphragm 80 as required to accommodate differently sized cups C. Either diaphragm 80',80" can be substituted for the diaphragm 80 without departing from the overall scope and intent of the present invention. Suitable diaphragm members, and operation of same to retain cups C releasably in the body 10, are described, e.g., in U.S. Pat. Nos. 5,199,601 and 5,201,869, both of which patents are hereby expressly incorporated by reference herein. Furthermore, suitable diaphragm members 80,80',80" are available commercially from Tomlinson Industries, Modular Dispensing Systems Division, Cleveland, Ohio 44125.

Once the diaphragm member 80 is fitted to the outermost edge 70 of the body 10, a clamp-member or clamp-ring 84 is fitted to the outermost edge 70 of the body 10 as shown in FIG. 1. The clamp-ring 84 defines a central opening 86 that is adapted for tight, frictional receipt of the outermost body edge 70 therein. Thus, after the diaphragm member 80 is fitted to the body edge 70, the clamp-ring 84 is also fitted to the body edge 70 and secures the diaphragm 80 in its operative position with a tight friction fit, i.e., a peripheral portion of the diaphragm 80 is pinched between the body edge 70 and the clamp-ring 84 as is readily apparent in FIG. 1. The clamp-ring 84 is preferably also defined as a one-piece molded plastic construction. The clamp-ring 84 is preferably annular in shape and circumferentially coextensive with the diaphragm to contact the diaphragm continuously or at intervals about the entire periphery of the diaphragm. An example of a dispenser including a clamp-ring 84 is disclosed in U.S. Pat. No. 5,222,628, the disclosure of which is hereby expressly incorporated by reference.

The cup storage body 10 can be secured to a mounting structure B in an arrangement where the open first end 20 of the body 10 is placed at a lower elevation than the closed second end 22. In this arrangement, cups C from the stack S are fed through the diaphragm opening 82 by gravity. The cup dispenser assembly A optionally comprises means for biasing the stack S of cups C toward the diaphragm 80 so that the closed end (bottom) of the outermost cup C projects outwardly through the diaphragm opening 80, regardless of the elevation at which the open body end 20 is arranged relative to the closed body end 22. In the illustrated embodiment, a coil spring 90 is disposed in the hollow cup storage region 14 coaxial with the axis L. A follower or cup pushing member 96 is closely and slidably positioned within the hollow cup storage region 14 of the body 10. A first end 92 of the coil spring 90 is seated against the cup pushing member 96, and a second end 94 of the spring 90 is seated against the transverse end wall 24 of the body 10.

The dispenser assembly A operates in a conventional manner as is well understood by those of ordinary skill in the art and as described in the aforementioned U.S. patents. A telescopically interfitted stack S of cups C is inserted into the cup storage space 14 through the central opening 82 of the diaphragm 80 with the open mouth of the innermost cup engaging the pushing surface 98 of the cup pushing member 96. The cup stack S is pushed into the cup storage space 14 with sufficient force to overcome the biasing force of the spring 90 so that the cup pushing member 96 moves inwardly toward the closed second end 22 of the body 10. After the cup stack S is loaded into the cup receiving region 14, the cup pushing member 96, in response to the biasing force of the spring 90, urges the cup stack S outwardly toward the open first end 20 of the body 10 so that the closed end or bottom of the outermost cup C in the stack S projects out of the diaphragm opening 82. To dispense a single cup C, a user manually pulls the outermost exposed cup C so that the diaphragm 80 distends (as shown in broken lines in FIG. 1) and so that the outermost cup C is able to pass through the diaphragm opening 82. However, the diaphragm 80 engages the next outermost cup C in the stack S and prevents its unintended exit from the cup storage space 14 together with the outermost cup C pulled by a user.

These diaphragm-type cup dispensers have enjoyed widespread commercial success, and are available from Tomlinson Industries, Modular Dispensing Systems Division, Cleveland, Ohio 44125. As noted, however, the diaphragm 80 has heretofore been held in its operative position by way of a clamp-ring 84 that is friction-fit to the body 10, with the periphery of the diaphragm pinched between the body 10 and the clamp-ring. Under especially rough handling or other extreme adverse conditions, these clamp-rings have been known to become separated from the storage body. This is obviously an undesired occurrence, and the present development is directed to a dispenser for cup-shaped articles that includes an improved clamp-ring securement feature.

SUMMARY

In accordance with a first aspect of the present development, a dispenser for cup-shaped articles comprises a body defining a storage region adapted for receiving for an associated stack of cup-shaped articles. A mounting collar is connected to the body. The mounting collar includes a flange projecting outwardly therefrom. A resilient diaphragm is located adjacent an open end of the storage region of the body. The diaphragm restricts the open end for controlled dispensing of associated cup-shaped articles from within said storage region. A clamp member secures the diaphragm adjacent the open end of the storage region of the body. The clamp member is engaged with the mounting collar with a snap-fit.

In accordance with another embodiment, a dispenser for cup-shaped articles comprises a body defining a storage region for receiving an associated stack of cup-shaped articles. The body comprises an open end that communicates with the storage region. A resilient diaphragm restricts the open end of the body. A clamp member is releasably secured adjacent the open end of the body and retains the diaphragm relative to the open end of the body. A mounting flange projects outwardly away from the body. The clamp member and mounting flange comprise mating structures that releasably secure said clamp member to the mounting flange.

In accordance with another embodiment, a dispenser for cup-shaped articles comprises a body that defines a storage region adapted for receiving for an associated stack of cup-shaped articles. A mounting collar is connected to the body and includes a flange projecting outwardly therefrom. A resilient diaphragm is located adjacent the open end of the storage region of the body. The diaphragm restricts the open end for controlled dispensing of associated cup-shaped articles from within the storage region. A clamp-ring member secures the diaphragm adjacent the open end of the storage region of the body. The clamp-ring member and the flange of the mounting collar are secured to each other via engagement of at least one structure of the flange with a mating structure of the clamp-ring member.

BRIEF DESCRIPTION OF THE DRAWINGS

The invention takes form in various components and arrangements of components, and in various steps and arrangements of steps, preferred embodiments of which are described herein and illustrated in the accompanying drawings that form a part hereof and wherein.

DETAILED DESCRIPTION

Figure 8:
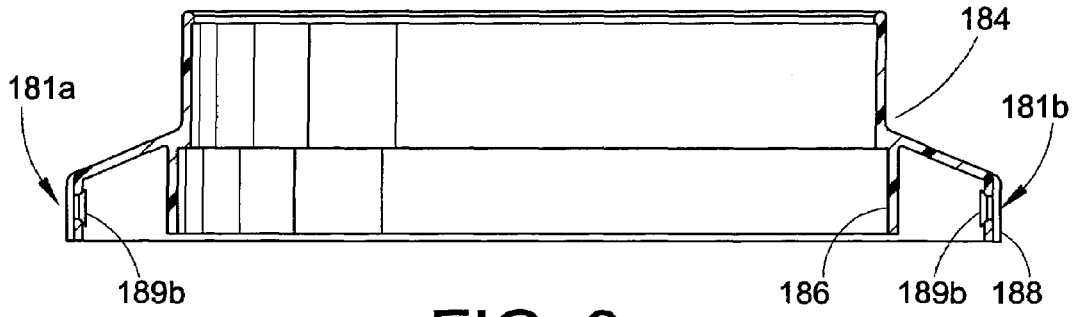
FIG. 8 is a sectional view taken along line 8-8 of FIG. 7.
Figure 9:
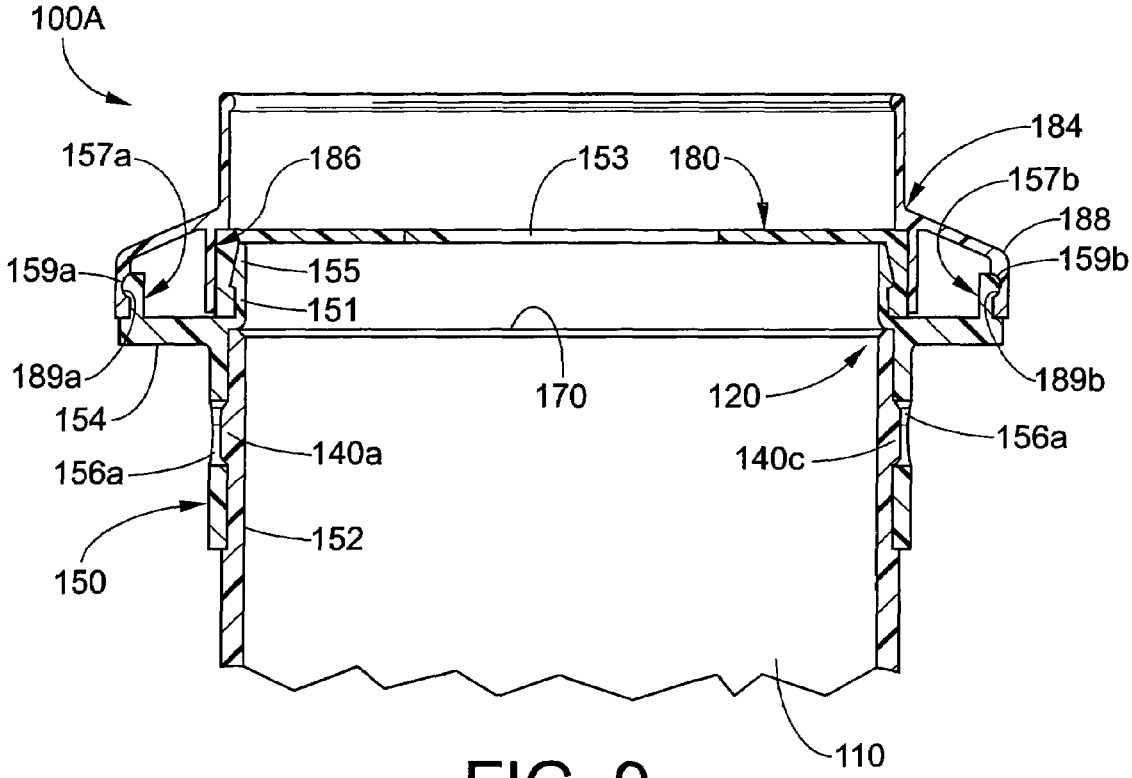
FIG. 9 is a partial sectional view of a dispenser for cup-shaped articles formed in accordance with the present development.

A dispenser for cups and other cup-shaped articles formed in accordance with the present development is illustrated in FIG. 9 and described with reference to all of FIGS. 3-10. Referring first to FIG. 9, except as otherwise shown and/or described, the dispenser assembly 100A shown in FIG. 9 is identical to the dispenser A described above with reference to FIGS. 1 and 2 (portions of the dispenser 100A have not been shown to simplify the drawing). As such, reference number and letters used in FIG. 9 to identify corresponding components of the dispenser 100A relative to the dispenser A are "100" greater than those used in FIGS. 1 and 2, and portions of the dispenser 100A that are identical to the dispenser A are not described further here.

In the illustrated embodiment, the dispenser 100A differs from the dispenser A primarily in that the outermost edge 170 of the cup storage body 110 is formed differently, as is the mounting collar 150. In particular, when the mounting collar 150 (shown separately in FIGS. 3-6) is fitted over the outermost edge 170 of the cup storage body 110, the outermost edge 170 of the body 110 does not project outwardly above the flange 154 of the mounting collar 150. Instead, the mounting collar 150 includes or defined an integral tubular projection 151 that includes an outermost edge 153 having a radially enlarged lip or bite-tooth 155 extending at least partially therearound. When the mounting collar 150 is fitted to the upper end 120 of the cup storage tube or body 110, outermost edge 170 of the body 110 is closely received within the base portion 152 of the mounting collar 150, and the tubular projection 151 of the mounting collar 150 projects outwardly away from the edge 170 of the body 110 so as to provide a good mounting location for a resilient diaphragm 180 adjacent the open end 120 of the body 110 for restricting the open end 120. The enlarged lip 155 of the edge 153 grips the diaphragm 180. The diaphragm 180 is located adjacent and restricts the open end 120 of body 110 even though, in this embodiment, it is not directly connected to the body 110 (but it is connected directly to the body in other embodiments as described below).

With continuing reference to FIG. 9 and FIGS. 3-6, the mounting collar 150 further comprises at least one and preferably at least first and second tabs 157*a*,157*b* that project outwardly from the circular flange 154 at diametrically opposed locations. The tabs 157*a*,157*b* are spaced radially outward from the tubular projection 151 on which the diaphragm 180 is mounted. The tabs 157*a*,157*b* are preferably molded as a one-piece construction with the collar 150, including the base portion 152, flange 154 and tubular projection 151 from a suitable polymeric material. As such, the tabs 157*a*,157*b* are adapted for limited resilient inward deflection toward and away from each other. The tabs 157*a*,157*b* preferably include enlarged outer ends 159*a*, 159*b*, respectively.

Figure 7:
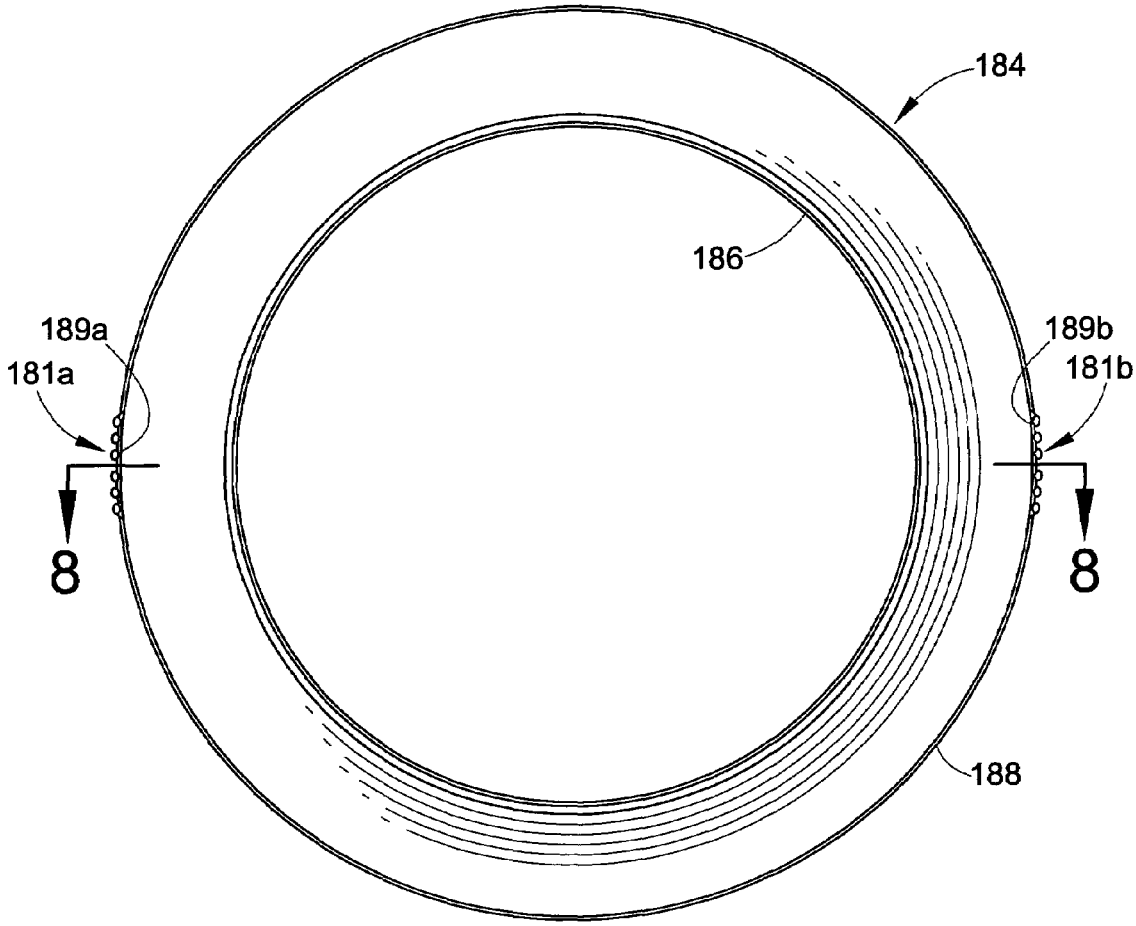
FIG. 7 is a bottom plan view of a clamp-member/clamp-ring formed in accordance with a first embodiment of the present development.

With reference now to FIGS. 7-9, the clamp-member or clamp-ring 184 is identical to the clamp-ring 84 described above, except that it includes first and second notches or indentations 189*a*,189*b* defined in an outer cylindrical wall 188 thereof (the wall 188 can be otherwise shaped). The notches 189*a*,189*b* are dimensioned and arranged for respective receipt of the enlarged outer ends 159*a*,159*b* of the tabs 157*a*,157*b* when the clamp-ring 184 is fully operatively connected to the mounting collar 150 to retain the diaphragm 180 in its operative position as shown in FIG. 9. More particularly, after a circular peripheral portion of the diaphragm member 180 is fitted to the outermost edge 153 of the tubular projection 151, the circular opening 186 of the clamp-ring 184 is frictionally engaged around the peripheral portion of the diaphragm 180 as shown in FIG. 9 so that the diaphragm 180 is pinched and/or gripped between the portion of the clamp-ring 184 that defines the opening 186 and the tubular projection 151 of the mounting collar 150. At the same time, the enlarged ends 159*a*,159*b* of the tabs 157*a*, 157*b* are received with a resilient snap-fit into the notches 189*a*,189*b* of the clamp-ring 184. Owing to the resilient nature of the tabs 157*a*,157*b*, the enlarged ends 159*a*,159*b* thereof of resiliently biased into engagement with the notches 189*a*,189*b* so as to retain the clamp-ring 184 in its operative position, i.e., in griping engagement with the diaphragm 180. The clamp-ring 184 can be detached by application of sufficient pulling force thereon to overcome the snap-fit established by receipt of the tabs 157*a*,157*b* in the respective notches 189*a*,189*b*, but engagement of the tabs 157*a*,157*b* with notches 189*a*,189*b* of clamp-ring reduces the likelihood of accidental dislodgement of the clamp-ring 184. As such, the clamp-ring 184 retains the diaphragm in its operative position, i.e., adjacent the open end 120 of body 110 to restrict same.

As shown in FIGS. 7 and 8, the clamp-ring 184 preferably includes external markings or indicia 181*a*,181*b* corresponding in number and location to the notches 189*a*,189*b* so that a user is able to align the notches 189*a*,189*b* with the tabs 187*a*,187*b* by visually aligning the tabs 157*a*,157*b* and the indicia 181*a*,181*b*, respectively. The external markings or indicia 181*a*,181*b* can be molded or otherwise formed integrally with the clamp-ring 184 (as shown a plurality of gripping ribs are molded integrally into the clamp-ring 184 as the indicia 181*a*,181*b*) or can be applied by paint, stickers, engraving, and/or other suitable and convenient means. Alternatively, at least one mark or indicia 181*a*,181*b* is provided on clamp-ring 184 to provide a location index for at least one of the notches 189*a*,189*b*.

With the foregoing in mind, those of ordinary skill in the art will recognize that the clamp-ring 184 and flange 154 of the mounting collar 150 define mating structures that engage each other so that the clamp-ring 184 is releasably secured to the flange 154 and less susceptible to accidental dislodgement relative to known dispensers.

Figure 1:
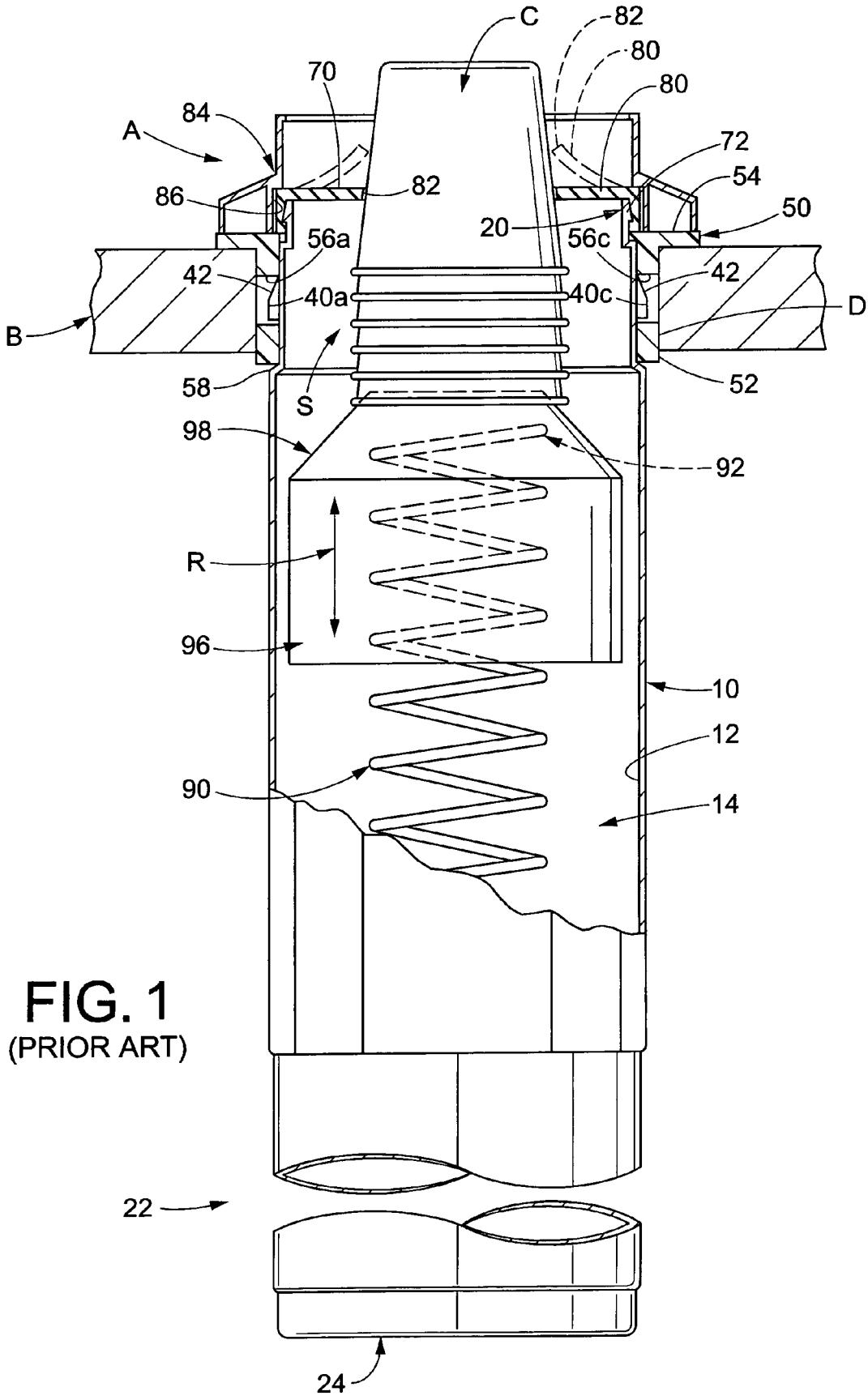
FIG. 1 (PRIOR ART)
FIG. 1 (prior art) illustrates a prior art cup dispenser as installed in a mounting structure, with portions of the dispenser and mounting structure broken away.
Figure 2:
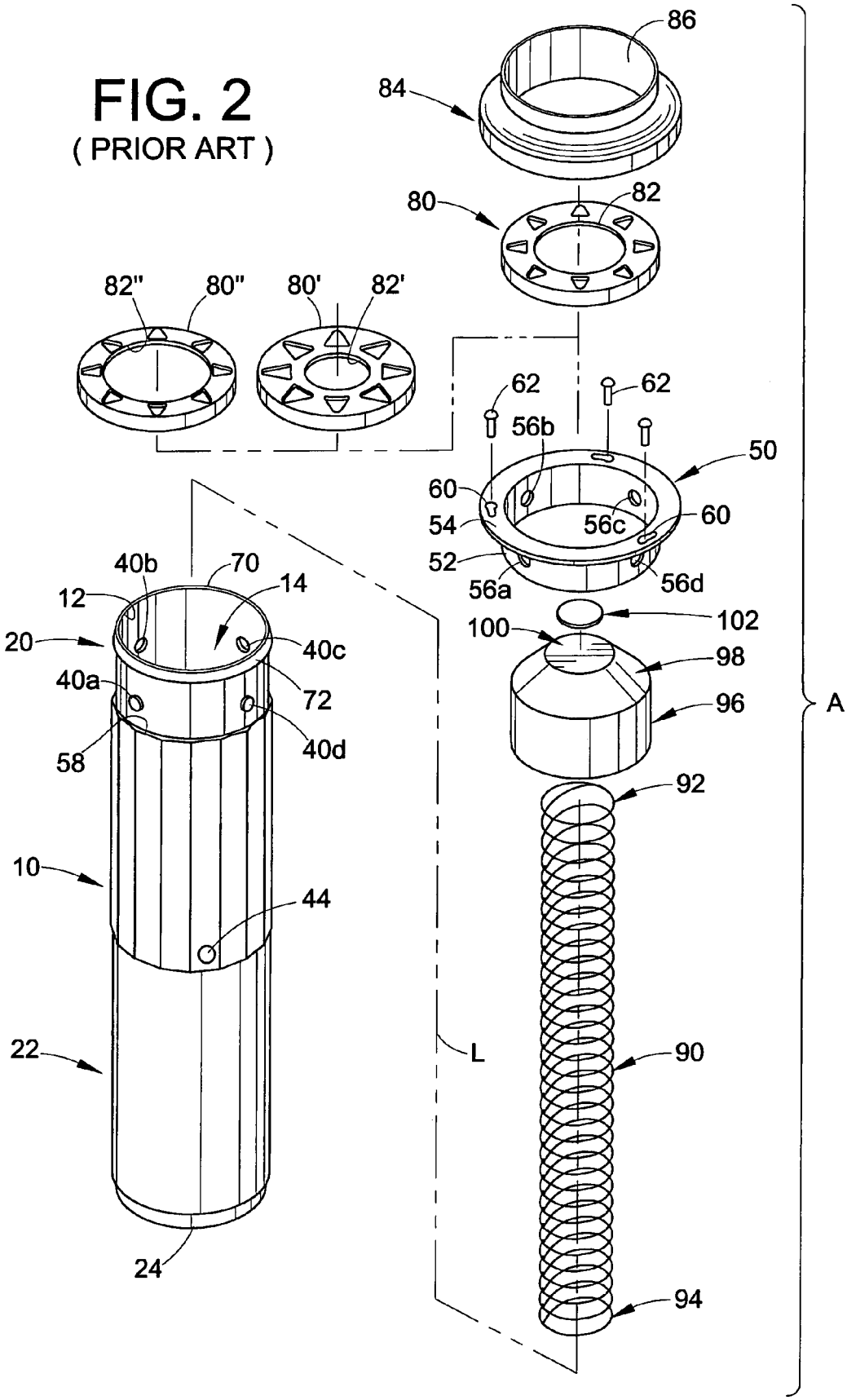
FIG. 2 ( PRIOR ART )
FIG. 2 (prior art) is an exploded perspective view of the prior art cup dispenser shown in FIG. 1 and showing alternative diaphragms.
Figure 3:
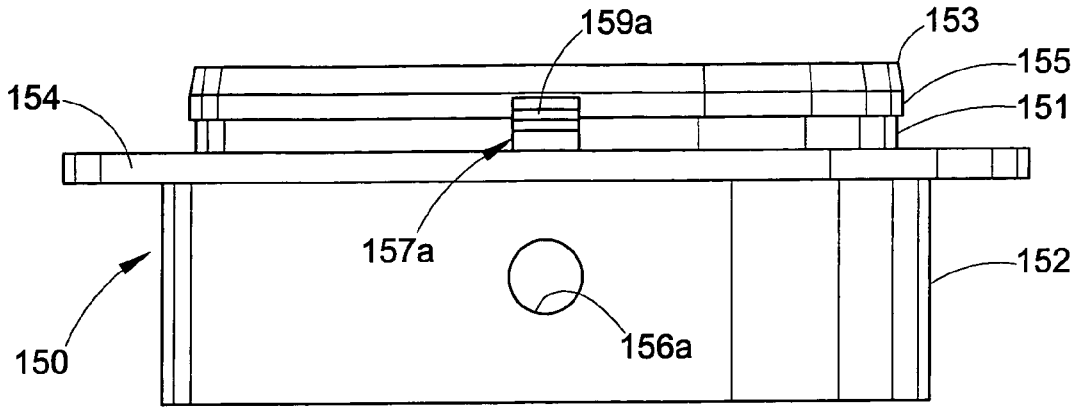
FIG. 3 is a side elevational view of a mounting collar for a dispenser formed in accordance with a first embodiment of the present development.
Figure 4:
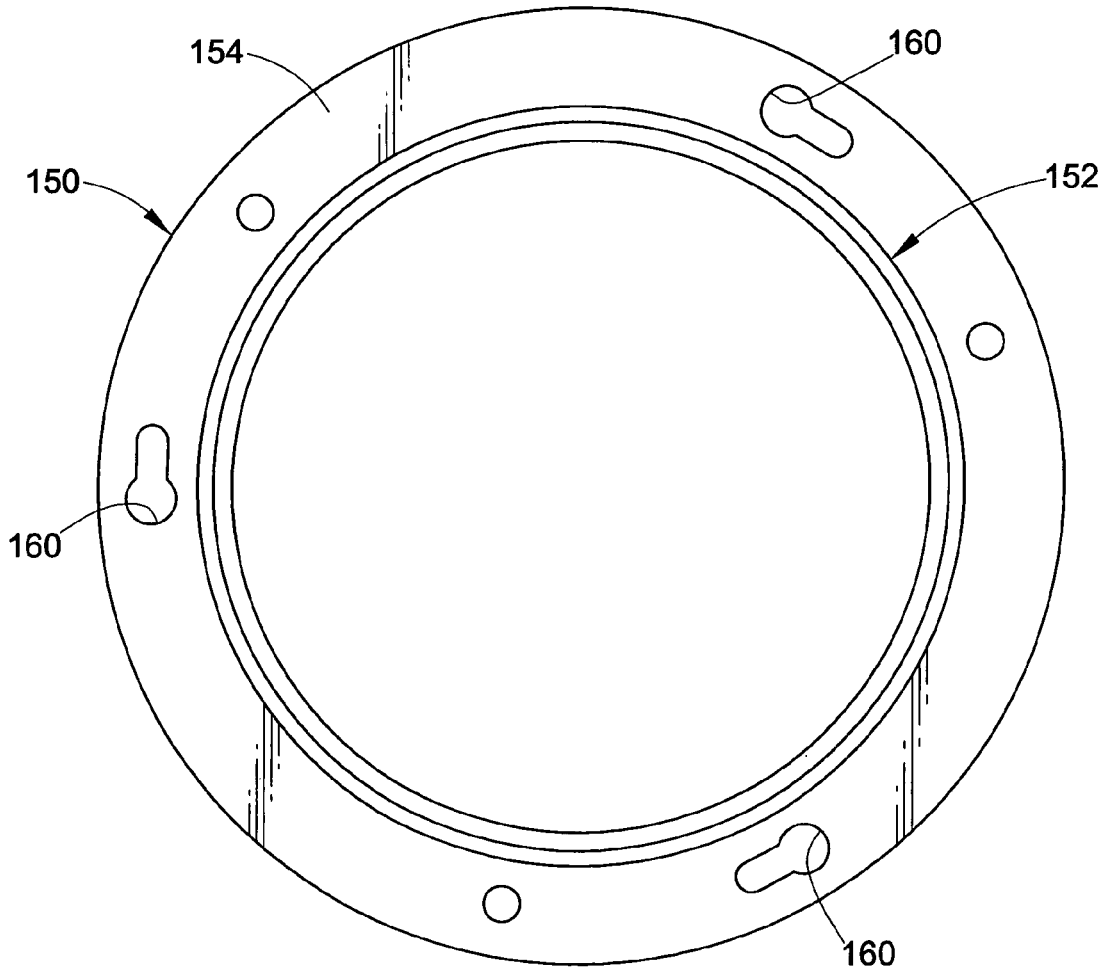
FIG. 4 is a bottom plan view of the mounting collar shown in FIG. 3.
Figure 5:
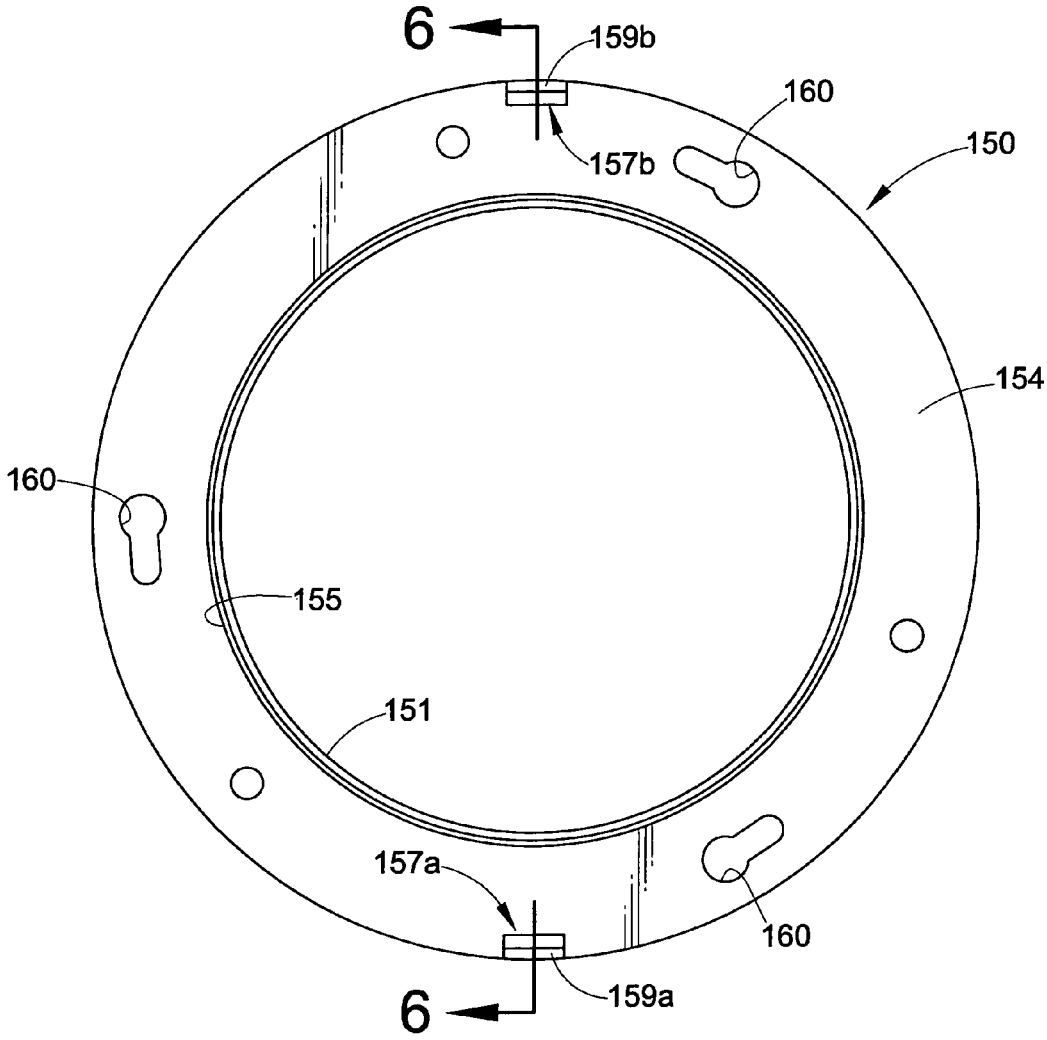
FIG. 5 is a top plan view of the mounting collar shown in FIG. 3.
Figure 6:
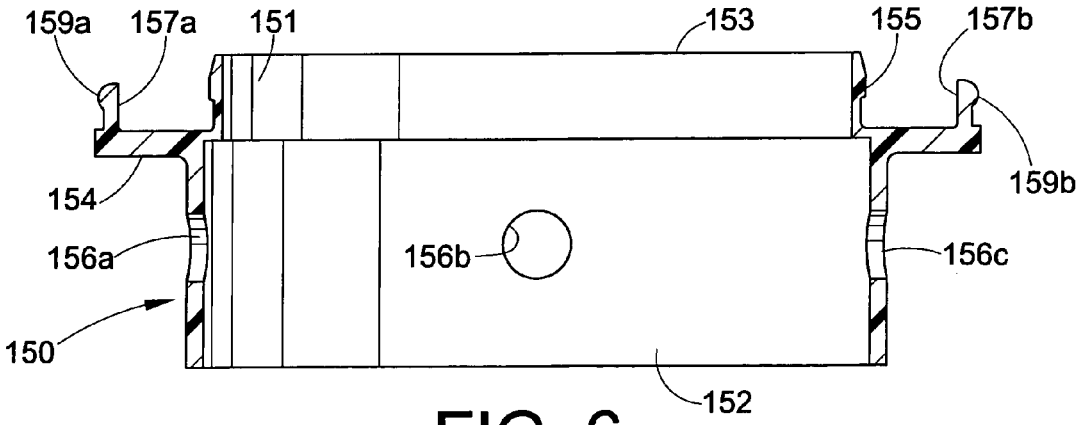
FIG. 6 is a sectional view taken along line 6-6 of FIG. 5.
Figure 10:
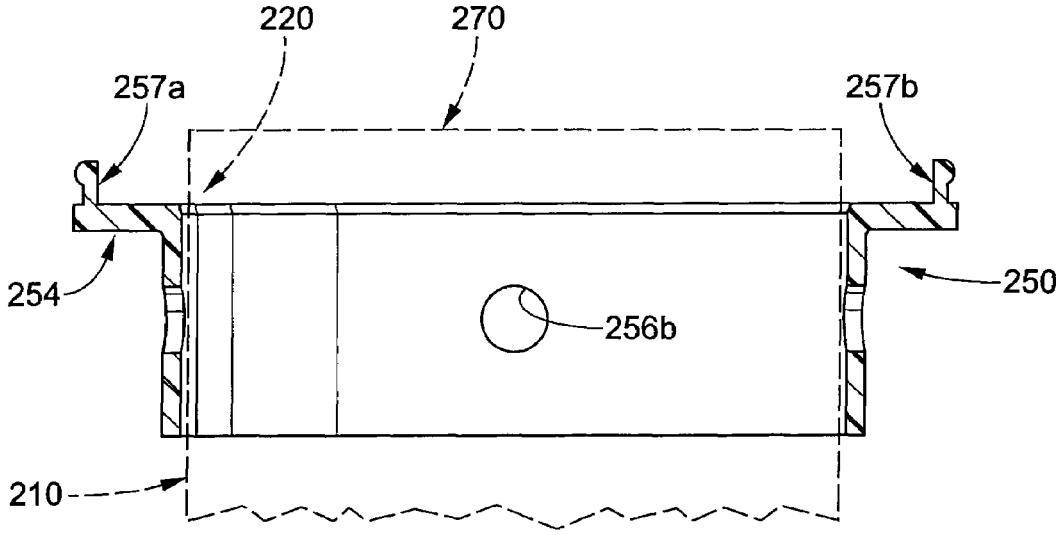
FIG. 10 is a sectional view of an alternative mounting collar formed in accordance with the present development.

FIG. 10 illustrates a mounting collar 250 formed in accordance with the present invention and usable with the clamp-ring 184 in the same manner as the mounting collar 150. The mounting collar 250 is identical to the collar 50 described in relation to FIGS. 1 and 2 except that it includes tabs 257*a*,257*b* that project outwardly from the flange 254 and correspond respectively to the tabs 157*a*,157*b*. The mounting collar 250 does not, however, include any tubular projection for mounting a diaphragm 180. Instead, as shown schematically in phantom lines, the mounting collar 250 is intended for use with metal or molded polymeric storage body 210 (e.g., body 10 as shown in FIGS. 1 and 2) that includes an open end 220 including an outermost edge 270 that extends through the mounting collar 250 and on which the diaphragm 180 is mounted.

Figure 11:
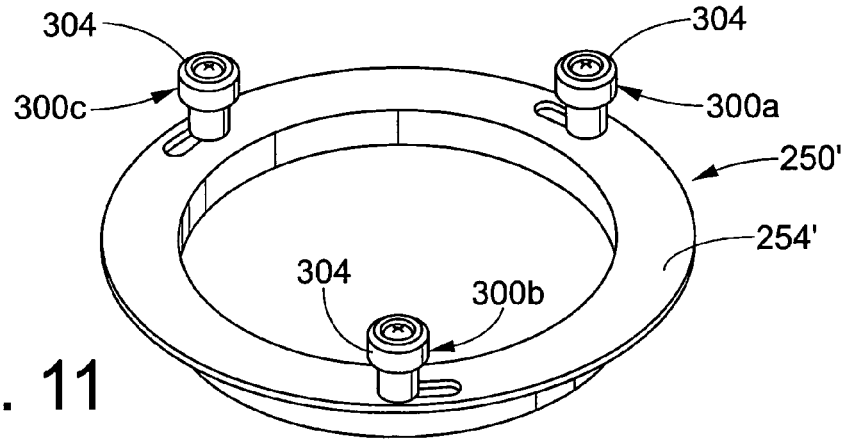
FIG. 11 illustrates another alternative mounting collar formed in accordance with the present development.
Figure 12:
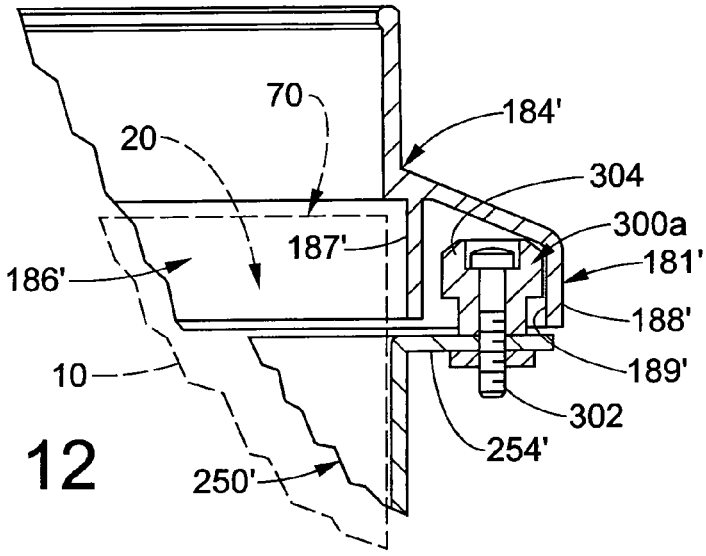
FIG. 12 is a partial sectional view that shows use of the mounting collar of FIG. 11 with the clamp ring of FIGS. 7 and 8.
Figure 13:
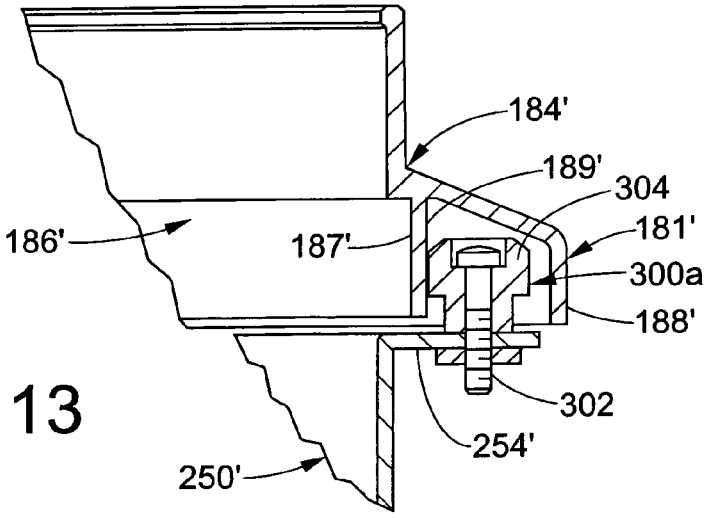
FIG. 13 is similar to FIG. 12 but shows the mounting collar of FIG. 11 as used with an alternative clamp ring.

FIGS. 11-13 illustrate another alternative mounting collar 250' that is similar to the mounting collar 250, i.e., the collar

Figure 14:
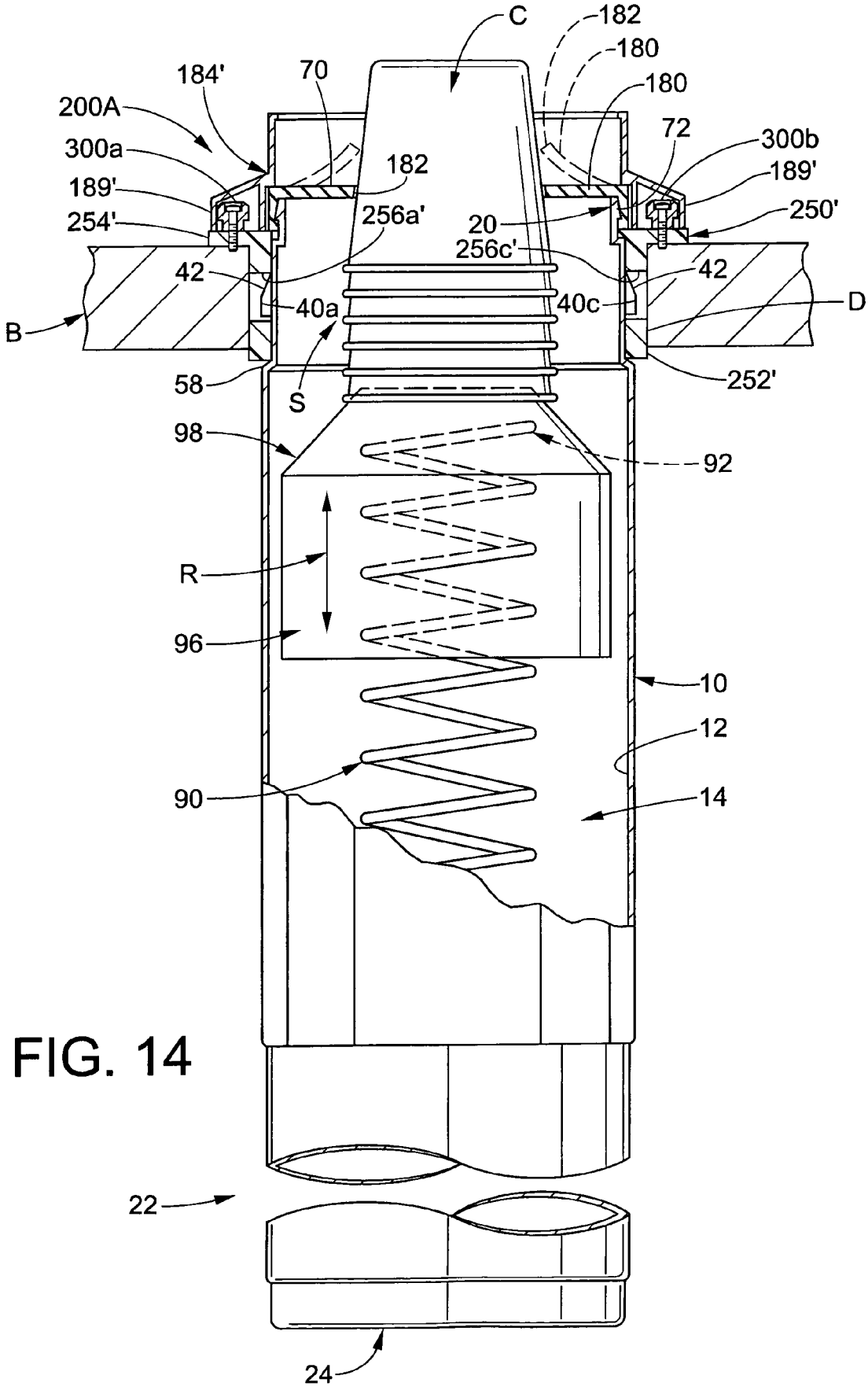
FIG. 14 shows a dispenser for cup-shaped articles, partially in section, comprising the mounting collar of FIG. 11 and the clamp ring of FIG. 12.

250' is intended for use with a storage body 10 (FIGS. 1 and 2) or a metal storage body that includes an open end 20 with an outermost edge 70 that extends through the collar 250' (as shown schematically at 10 in broken lines in FIG. 12). As shown in FIG. 14, a diaphragm 180 (FIG. 14) is mounted on the edge 70 and retained by the clamp-ring 184' to form a dispenser 200A for dispensing a stack S of cups C or other cup-shaped articles. Unlike the collar 250 that includes integral tabs 257*a*,257*b* (as shown in FIG. 10) to engage a clamp-ring 184, the mounting collar 250' includes a plurality of circumferentially-spaced studs or buttons 300*a*,300*b*, 300*c* projecting outwardly from the flange 254' thereof. In the illustrated embodiment, three studs 300*a*-300*c* are provided and are fastened to the flange 254' via fasteners 302. These studs 300*a*-300*c* are defined from rigid or resilient material such as a suitable plastic material and each includes or defines an enlarged or bulbous outer end 304. The mating clamp-ring 184' (see FIGS. 12 and 14) is identical to the clamp-ring 184 except that it includes notches or undercuts 189' dimensioned and positioned to receive the respective enlarged ends 304 of the studs 300*a*-300*c* when the clamp-ring 184' is operatively connected to the mounting collar 250' as shown in FIGS. 12 and 14. In FIG. 12, the undercuts 189' are shown as being defined in the outer wall 188' as described above in relation to the clamp-ring 184. Alternatively, the undercuts 189' are defined in an inner wall 187' that defines the opening 186'. In either case, suitable markings or indicia 181' such as labels, ribs, colored markings and/or the like are provided to assist a user in aligning the undercuts 189' with the buttons 300*a*-300*c* when installing the clamp-ring 184'.

In one embodiment, the collar 250' mounts to the cup storage body in the exact same manner as the collars 50,150,250 and, thus, includes the noted recesses or apertures (two are shown in FIG. 14 at 256*a*',256*c*') for receiving and retaining the bosses 40*a*-40*d* of the body 10. Alternatively, the collar 250' is secured to a cup storage body via screws, rivets, or other fasteners, e.g., when the body is defined from stainless steel.

The development has been described with reference to preferred embodiments. It is not intended that the scope of the claims be limited to the preferred embodiments. Instead, it is intended that the claims be construed literally and/or according to the doctrine of equivalents as broadly as legally possible.

The invention claimed is:

1. A dispenser for cup-shaped articles, said dispenser comprising:

a body defining a storage region adapted for receiving for an associated stack of cup-shaped articles;

a mounting collar connected to said body, said mounting collar including a flange projecting outwardly therefrom;

a resilient diaphragm located adjacent an open end of said storage region of said body, said diaphragm restricting said open end for controlled dispensing of associated cup-shaped articles from within said storage region;

a clamp-member engaged with said mounting collar to secure said diaphragm adjacent said open end of said storage region of said body, said clamp-member including a plurality of notches defined in a wall thereof;

a plurality of projections connected to said flange of said mounting collar, wherein each of said plurality of projections is received in a corresponding one of said notches with a resilient snap-fit when said clamp-member is engaged with said mounting collar, and wherein said clamp-member is selectively separable from said mounting collar by exertion of a pulling force thereon sufficient to cause said projections to disengage from said notches;

wherein said clamp-member further comprises indicia to indicate a location of at least one of said plurality of notches to allow for alignment of said at least one notch with one of said projections of said mounting collar flange.

2. The dispenser as set forth in claim 1, wherein each of said projections comprises a resiliently deflectable tab including an enlarged outer end, wherein each of said resiliently deflectable tabs is defined as a one-piece construction with said flange of said mounting collar.

3. The dispenser as set forth in claim 2, wherein said mounting collar, said flange, and said plurality of projections are all defined together as a one-piece molded polymeric construction.

4. The dispenser as set forth in claim 1, wherein each of said plurality of projections comprises a button-like member secured to said flange.

5. The dispenser as set forth in claim 4, wherein said button-like member of each of said studs is secured to said flange of said mounting collar by a fastener.

6. The dispenser as set forth in claim 1, wherein said body defines a plurality of bosses, and wherein said mounting collar comprises a plurality of recesses into which said bosses are respectively received to provide a releasably connection between said mounting collar and said body.

7. The dispenser as set forth in claim 1, wherein said mounting collar comprises a tubular projection including an outermost edge, and wherein said diaphragm is mounted to said outermost edge of said tubular projection.

8. The dispenser as set forth in claim 7, wherein said outermost edge of said tubular projection comprises a radially enlarged bite tooth extending at least partially therearound.

9. The dispenser as set forth in claim 1, wherein said open end of said storage region of said body extends through said mounting collar, and wherein said diaphragm is placed in covering relation over said open end.

* * * * *